US005148478A

United States Patent [19]

Saltwick et al.

[11] Patent Number: 5,148,478

[45] Date of Patent: Sep. 15, 1992

[54] SYSTEM AND METHOD FOR COMMUNICATIONS SECURITY PROTECTION

[75] Inventors: John M. Saltwick, Phoenix; Dean Scarinci, Glendale, both of Ariz.

[73] Assignee: Syntellect Inc., Phoenix, Ariz.

[21] Appl. No.: 628,701

[22] Filed: Dec. 17, 1990

Related U.S. Application Data

[63] Continuation of Ser. No. 354,261, May 19, 1989.

[51] Int. Cl.[5] ..... H04K 1/02

[52] U.S. Cl. ..... 380/6; 380/7; 455/1

[58] Field of Search ..... 380/2, 6, 7, 8; 455/1; 342/121

[56] References Cited

U.S. PATENT DOCUMENTS

| | | | |
|---|---|---|---|
| 3,600,685 | 8/1971 | Doyle | 455/1 |
| 3,624,297 | 11/1971 | Chapman | 380/6 |
| 3,651,268 | 3/1972 | Rivkin | 380/6 |
| 3,654,604 | 4/1972 | Crafton | 380/2 |
| 3,689,688 | 9/1972 | Shanahan et al. | 380/7 |
| 3,718,765 | 2/1973 | Halaby | 380/6 |
| 3,859,457 | 1/1975 | Kirk, Jr. | 380/7 |
| 3,899,633 | 8/1975 | Sorenson et al. | 380/7 |
| 3,985,958 | 10/1976 | Dudley | 380/6 |
| 4,160,875 | 7/1979 | Kahn | 380/6 |
| 4,225,962 | 9/1980 | Meyr et al. | 380/6 |
| 4,393,276 | 7/1983 | Steele | 380/6 |
| 4,468,667 | 8/1984 | Baylor | 380/6 |
| 4,573,205 | 2/1986 | Nash | 380/6 |
| 4,625,081 | 11/1986 | Lotito et al. | 380/2 |
| 4,727,568 | 2/1988 | Morishima | 380/6 |
| 4,972,469 | 11/1990 | Saltwick et al. | 380/6 X |

*Primary Examiner*—Tod Swann
*Attorney, Agent, or Firm*—Streich Lang

[57] ABSTRACT

A system and method are disclosed for preventing intelligible interception of information signals transmitted over a two-direction line. A masking signal is applied through a hybrid circuit at the receiving end of the line, and this masking signal, which appears on the line together with the information signal, prevents the intelligible decoding. Only at the receiving end of the line, where the hybrid circuit attenuates the masking signal which it receives at its receive port, can intelligible decoding take place. Signal processing techniques used at the receiving end permit larger amplitude masking signals to be used, thus creating even greater confusion for an unauthorized detecting mechanism which is coupled to the line.

84 Claims, 4 Drawing Sheets

SYSTEM AND METHOD FOR COMMUNICATIONS SECURITY PROTECTION

This is a continuation of application Ser. No. 354,261 filed May 19, 1989, still pending.

This invention relates to communications systems, and more particularly to security protection arrangements therefor.

The use of the public telephone system for computer communications and other data services is widespread. Services which are provided involve access to bank accounts, credit limit reporting, credit card transactions, and order entry functions. Communications are typically accomplished by encoding data to be transmitted as data signals. Examples of encoding are frequency shift keying (FSK), phase shift keying (PSK), and other forms of modulation using modems. Among the more popular forms of transmission are dual tone multi-frequency data (DTMF), commonly called Touchtone, and multi-frequency (MF) data encoding.

In order for a caller to access specific information it is usually necessary for the caller to enter an identifying number, such as an account number. For sensitive transactions such as funds transfer, accepted security procedures also require the entry of a security code, commonly known as a personal identification number or PIN. When transmitted, the account number and PIN are subject to compromise by someone eavesdropping on the communications line with a decoding device.

It is the primary object of this invention to provide a security system which makes it difficult or impossible to compromise security by eavesdropping on the telephone connection during the transmission of sensitive data.

In accordance with the principles of our invention, a masking signal is transmitted from the receiving unit during input of sensitive information at the sending device. A masking signal, as used herein, is a signal which tends to disable or confuse an eavesdropping detector. Examples are signals which distort the information signal; add to the frequency spectrum, amplitude and/or phase of the information signal; or are similar to the information signal so that a detector captures false information. The receiving unit is equipped with a means for canceling out the masking signal so that its signal detector is able to detect the information which was sent reliably and accurately. The cancellation of the masking signal is performed at the receiving site because the cancellation depends on knowledge of the specific characteristics of the masking signal and they may vary over time, e.g., in frequency, amplitude and/or phase.

The exact nature of the masking signal depends on the encoding technique used for the information signal to be protected. One common way of encoding numeric information is to use the dual tone multi-frequency scheme (DTMF). In this scheme, the keypad comprises four rows of four buttons each. Each row and column has a unique frequency associated with it. Depressing a key sends a signal consisting of the corresponding row frequency and column frequency. For example, the digit 1 is sent as a signal composed of tones at 697 Hz and 1209 Hz. A DTMF detector decodes a valid digit only when it receives exactly one row frequency and one column frequency. If two or more row or column tones are detected simultaneously, or if a tone which is not either a row or column tone is detected, the signal is not recognized as a valid DTMF digit. This scheme is used to prevent the improper detection of voice as a valid digit.

In order to mask the transmission of DTMF digits, a masking signal consisting of at least two row tones or two column tones can be used. Thus, no matter what row and column tones characterize a transmitted digit, an eavesdropper would detect at least three tones on the transmission line with no way to determine which two constitute the actual DTMF digit.

Another common data encoding technique is frequency shift keying (FSK). In this method, two or more carrier frequencies are used to encode binary data. With a tone of 980 Hz encoding a "mark", and a tone of 1180 Hz encoding a "space", a masking signal consisting of the 980 Hz and the 1180 Hz carrier frequencies could be used. In full duplex FSK, only the originate "mark" and "space" may need to be masked to provide security for the sending device.

Further objects, features and advantages of our invention will become apparent upon consideration of the following detailed description in conjunction with the drawing, in which FIG. 1 depicts, symbolically the type of communications over the public telephone system with which the present invention is concerned;

Figure 1:
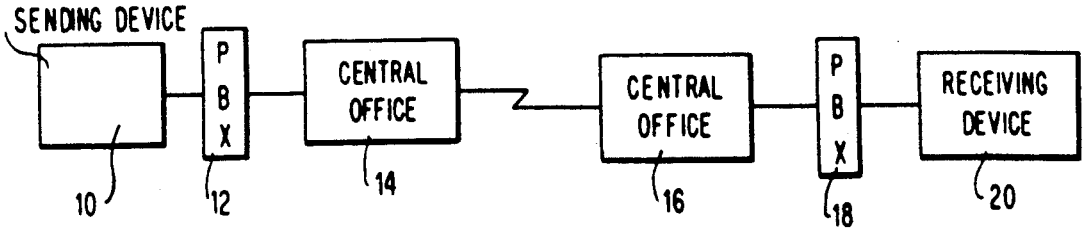
Figure 8:
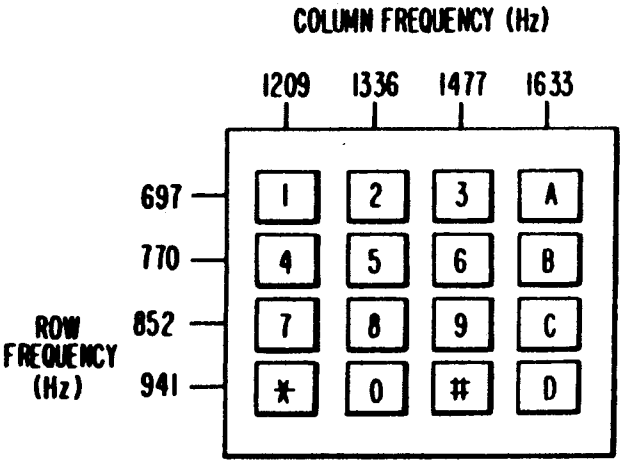
FIG. 8 depicts the row and column frequency assignments commonly used in the DTMF signaling scheme.

FIG. 1 depicts a typical data communications path over the switched public telephone network. The sending device 10 may be a telephone instrument capable of transmitting DTMF signals, or it may be a more sophisticated automated device such as a credit card transaction terminal. FIG. 8 depicts a typical DTMF keypad, along with the row and column frequency assignments which are in common use. The receiving device 20 in FIG. 1 is typically a computer, with a front end processor often connecting the computer to the telephone line. As is well known in the art, the path may be established over trunk lines between two or more central offices 14, 16. There may also be other intervening facilities, such as PBXs 12, 18.

Figure 2:
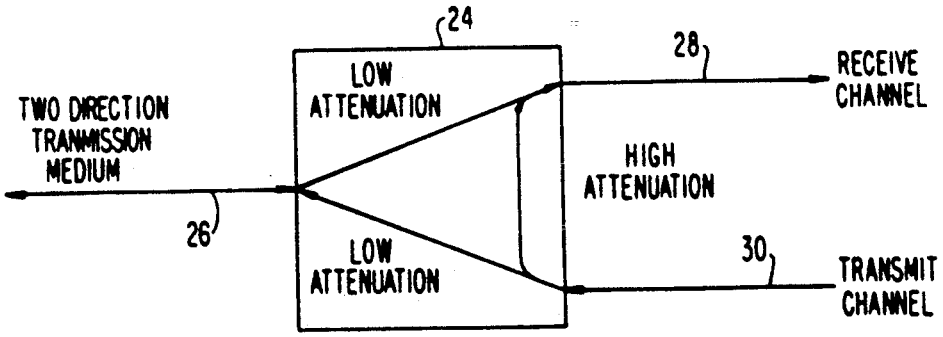
FIG. 2 depicts symbolically a device known as a "hybrid" whose use is standard in the telephone art.
Figure 3:
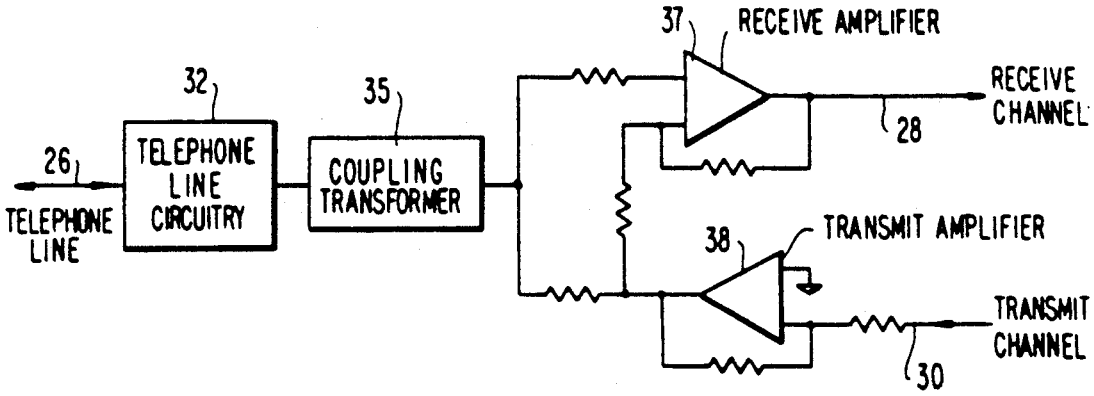
FIG. 3 is a more detailed representation of a hybrid device.

A hybrid circuit is a three-port device, as shown in FIG. 2. One port 26 is a bi-directional transmit and receive channel. A receive-only channel and a transmit-only channel make up the other two ports 28, 30. The function of the hybrid 24 is to separate the bi-directional transmit/receive port into respective transmit and receive channels. The more detailed drawing of FIG. 3 shows one way in which a hybrid may subtract the signal on the transmit channel from the signal at the bi-directional port to give rise to the signal on the receive channel. The key to the operation of the hybrid is that the signal at the output of transmit amplifier 38 is extended to the inverting input of differential amplifier 37; this receive amplifier subtracts the signal on the transmit channel from the signal on telephone line 26 (which is typically coupled to the hybrid through a coupling transformer 35 and other telephone line circuitry 32). The hybrid circuit can be characterized by the attenuations between the three ports, as depicted in FIG. 2. The basic idea is that a signal on the transmit channel is highly attenuated on its way to the receive channel; in other words, signals from the transmit channel are extended with relatively low attenuation to the telephone line, and signals on the telephone line are extended with relatively low attenuation to the receive channel, while very little of the signal which originates on the transmit channel appears on the receive channel.

A typical use of a hybrid circuit would be in a central office, such as central office 16 in FIG. 1. But the connections shown in FIGS. 2 and 3 would in this case be reversed. The transmit and receive channels are typically trunk channels, while the telephone line is extended to the PBX 18 or directly to the receiving device 20. Two-way signals typically appear on the telephone line extended to a handset, while separate paths are provided over trunks for signals transmitted in the two different directions. In our invention, however, a hybrid circuit is poled in the direction shown in FIGS. 2 and 3.

Figure 4:
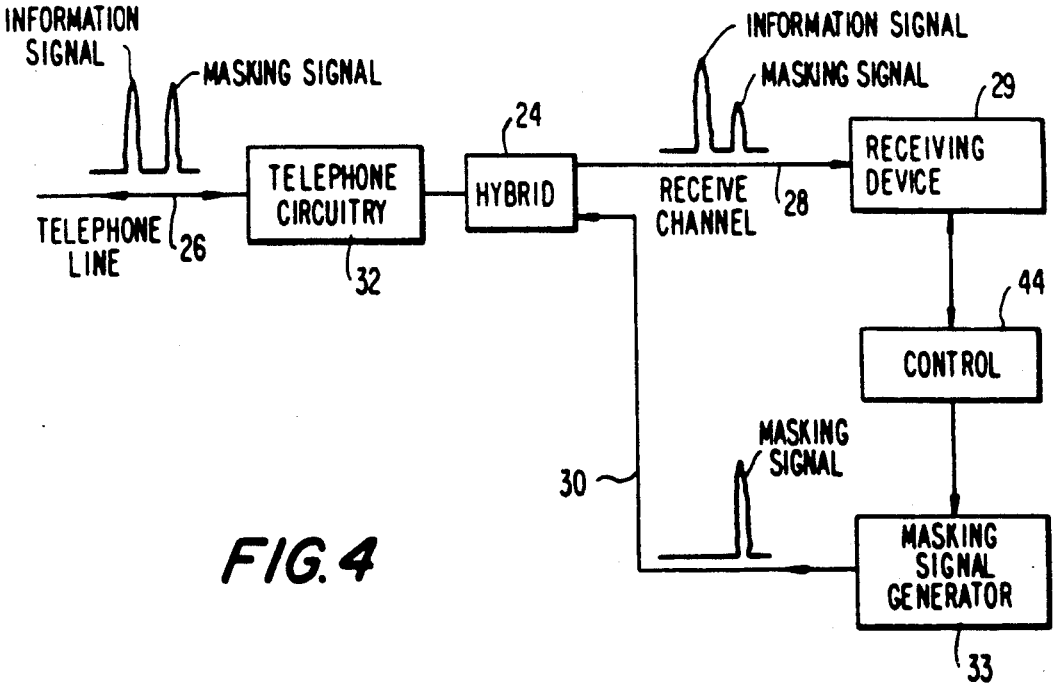
FIGS. 4–7 depict four embodiments of our invention.

The most elementary form of the invention is shown in FIG. 4. In data communications a hybrid 24 is sometimes used anyway. Receive channel 28 is shown extended to a receiving device, which is typically a DTMF detector at the data processing site. Very often it is necessary to transmit signals to the sending device, typically automated voice signals under the control of the data processor. For this purpose a transmit channel 30 is utilized, and hybrid 24 serves to couple transmitted signals to telephone line 26, and to couple signals on the telephone line to the receiving device over channel 28. The hybrid serves to attenuate the transmitted signals on channel 30 such that they appear at a much lower level on the receive channel 28. As shown in FIG. 4, a masking signal generator 33 is used to apply a masking signal on channel 30. Voice or even data signals may also be applied on channel 30, but the significant thing about masking signal generator 33 is that it applies a masking signal on channel 30 at the time that the sending device 10 of FIG. 1 transmits sensitive data in the opposite direction to the receiving device. The masking signal is shown symbolically in FIG. 4, and it appears together with the information signal transmitted in the opposite direction on line 26. The function of hybrid 24 is to reduce the amplitude of the masking signal relative to that of the information signal on receive channel 28. It is in this way that the receiving device can discriminate between the information and masking signals, while an unauthorized tapping of line 26 will not result in intelligible interception of the information signal.

The simple hybrid arrangement of FIG. 4 can be augmented by signal processing. The signal processing can take two forms, one shown in FIG. 5 and the other shown in FIG. 6. The most sophisticated system is that of FIG. 7, in which both forms of signal processing are used. The object of the additional signal processing is to allow a more "confusing" masking signal to appear on line 26. The problem with the masking signal becoming more and more confusing—if sufficient signal processing is not employed—is that that portion of it which does appear in the receive channel may confuse the receiving device; that is because no hybrid circuit is perfect and some small part of the masking signal will almost always appear in the receive channel, an effect known as "sidetone". (To the extent that the telephone network produces an echo, even in the absence of sidetone, the masking signal which is transmitted back from the sending site to the receiving site is not attenuated by the hybrid circuit, and thus if the telephone network is not "perfect" there will invariably be some portion of the masking signal in the receive channel because what is received as an echo is treated as part of the information signal transmitted by the sending device.) Signal processing is most conveniently implemented by using standard digital signal processing integrated circuits, such as the Texas Instruments TMS320C25 integrated circuit. There are standard echo cancellation and sidetone cancellation algorithms used in the art, and these types of algorithm can be used in the more sophisticated embodiments of the invention shown in FIGS. 6 and 7. It is to be understood, however, that analog signal processing techniques can also be used. In any event, the embodiment of FIG. 5 requires relatively unsophisticated signal processing.

In the hybrid approach, the masking signal should be properly adjusted so as not to block detection of the information signal at the receiving end. Due to the dynamic range of possible incoming DTMF signals (typically 30 db), and assuming a relatively simple hybrid with a rejection of 10 to 20 db, it may be difficult to determine a single level of masking signal which will provide interference for eavesdropping detectors yet allow detection of all DTMF signals at the receiving end. For proper detection at the receiving end, it is preferable that the masking signal in the receive channel be around 10 db below the incoming information signal for any level of the information signal.

Figure 5:
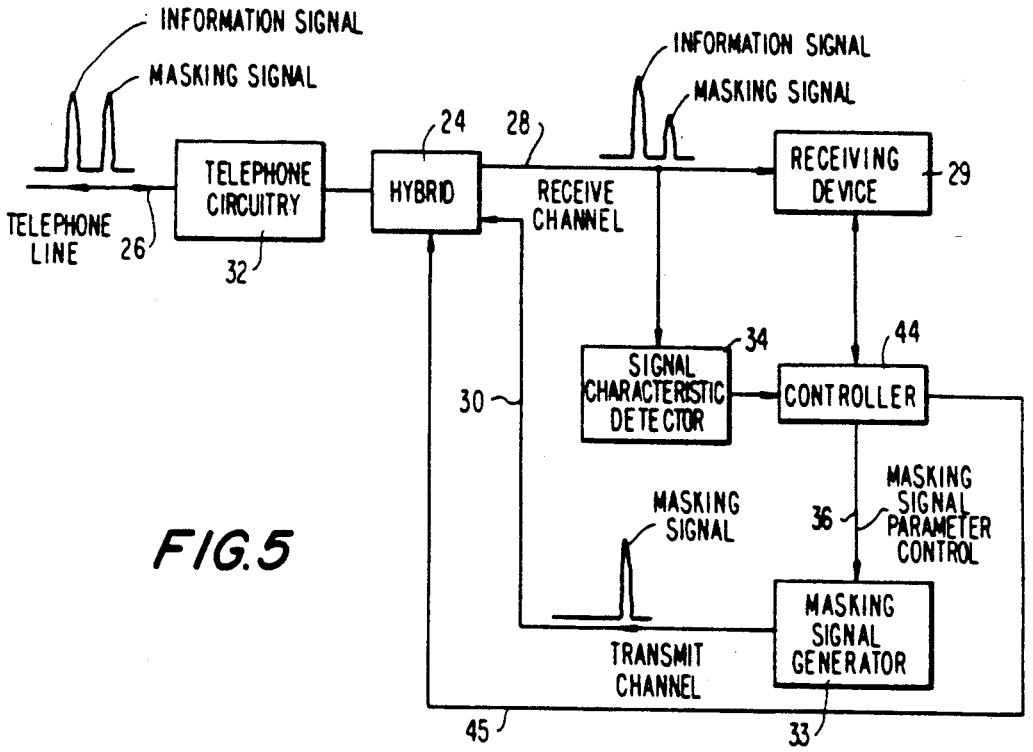

A more preferred embodiment of the hybrid approach therefore provides means for monitoring the incoming DTMF signal for its energy content before transmitting the masking signal, as shown in FIG. 5. The energy content may be checked on the first DTMF input, and it defines the necessary output level of the masking signal. The output level of the masking signal in this embodiment is dependent on the first input and remains constant until after the sensitive information has been accepted and the masking signal is disabled.

The signal processing is controlled in the embodiment of FIG. 5 by signal characteristic detector 34. This element may be any standard device for checking a characteristic of the information signal (or even of the masking signal as it appears on the receive channel), such as its peak amplitude, and adjusting the masking signal generator 33 by applying a control signal to the masking signal parameter control input of the device. The form of the invention shown in FIG. 5 is not truly a feedback arrangement. What is monitored is a characteristic of the information (or masking) signal, and what is controlled is a parameter (such as amplitude) of the masking signal. The larger the level of the information signal on the receive channel, the larger the level of the masking signal which can be tolerated on the receive channel, and this allows the amplitude of the masking signal applied to the transmit channel to be increased. Of course, the larger the amplitude of the masking signal which appears on line 26, the more difficult it will be for intelligible interception of the information signal.

Figure 6:
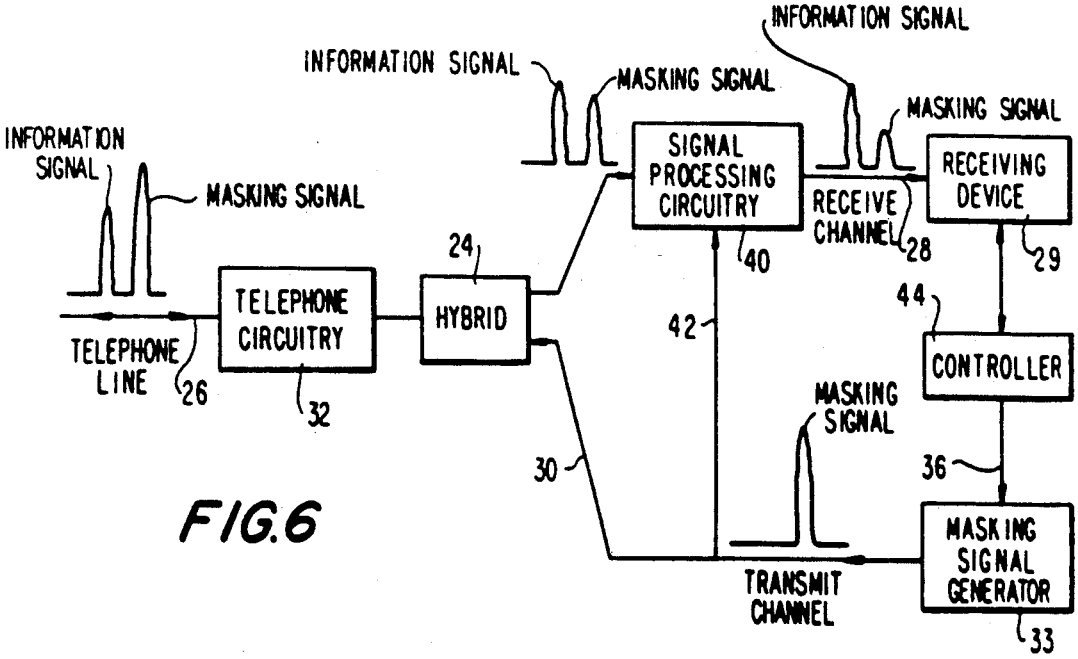

A more sophisticated form of signal processing is shown in FIG. 6. Here, signal processing circuit 40 subtracts a signal which is a function of the masking signal extended to it over conductor 42 from the received signal which is derived from hybrid circuit 24. Comparing FIGS. 5 and 6, the masking signal in FIG. 6 is shown larger in amplitude. Referring to FIG. 5, the information and masking signal levels on telephone line 26 are shown to be equal. (This is purely for the sake of convenience, it being understood that it is probably unlikely that they would be exactly equal in actual practice.) Because the masking signal on transmit channel 30 is greater in amplitude in the embodiment of FIG. 6, the masking signal is shown larger than the information signal on telephone line 26, thus making it more difficult to achieve intelligent interception of the information signal. Hybrid 24 reduces the amplitude of the masking signal which appears at the receive-only port, but because a larger masking signal was used in the first place, it will be apparent that the masking signal amplitude relative to that of the information signal is greater at the output of the hybrid in FIG. 6 than at the output of the hybrid in FIG. 5. It is signal processing circuitry 40 which further attenuates the level of the masking signal by subtracting a replica of the masking signal which appears on conductor 42 from the composite signal applied to the input of the signal processing circuitry. As shown in FIG. 6, the relative amplitudes of the information and the masking signals applied to the receiving device are the same as shown in FIG. 5.

Figure 7:
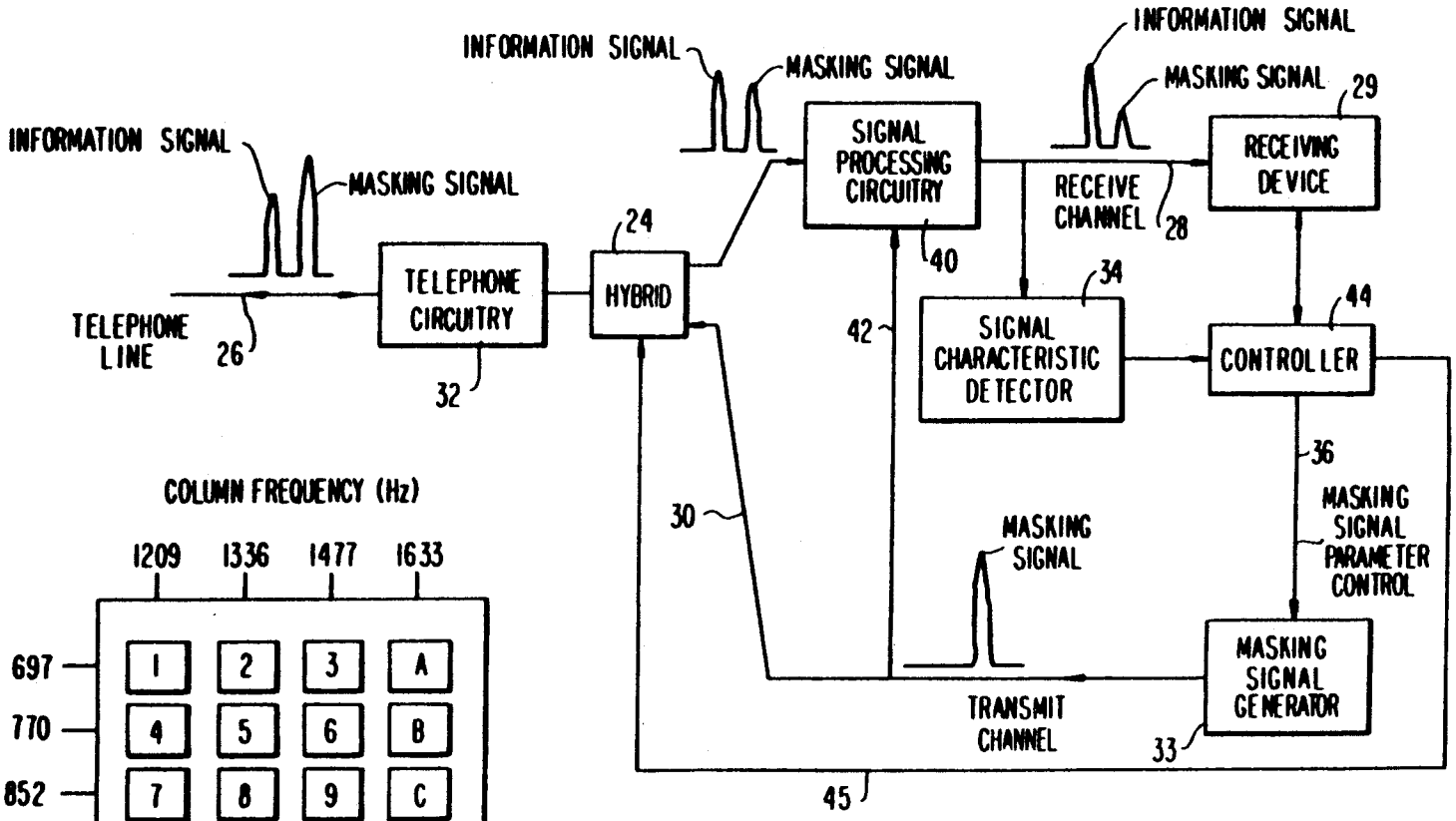

The embodiment of FIG. 7 combines the features of the embodiments shown in FIGS. 5 and 6. Signal characteristic detector 34 is provided to control the amplitude of the masking signal which is applied to the transmit channel 30. In addition, the more sophisticated form of signal processing circuitry 40 is used to further reduce the level of the masking signal which appears at the receive-only port of the hybrid circuit.

The masking signal for DTMF coding can be achieved by transmitting two row frequency tones. (See FIG. 8.) A masking signal of one row frequency at the proper level would block detection of digits in the other three rows. For example, if the masking signal is the row 1 frequency (697 Hz), digits in the other three rows (2, 3, 4) would not be decoded because there would be two row tones present and this would represent an invalid DTMF signature. If the masking signal is the row 4 frequency (941 Hz), digits in rows 1, 2, 3 would not be decoded. Therefore, if two row tones are used as the masking signal, all digits will be blocked from detection. It has been found that the row 1 and row 4 frequencies are the best choices; this combination produces uniform blocking for all digits. The concept is also applicable to the use of column frequencies as masking signals. It has been found experimentally that two row frequencies and one column frequency provide the best confusion to DTMF detectors. This is primarily due to more energy at invalid frequencies being present at the decoder, thus providing greater confusion for eavesdropping detectors. [Some frequencies other than row and column frequencies have been found effective as masking signals. However, they have not thus far provided consistent masking for eavesdropping devices.]

There are two types of DTMF detectors. In the first type, detection is based only on valid DTMF row and column frequencies. In the second type, detection is based on valid row and column frequencies with the added requirement that energies other than row and column frequencies not be present. Detectors of the second type monitor these energies to discriminate between speech and proper DTMF signaling. If frequencies exist other than row and column frequencies, the decoders assume that the waveforms are speech generated and will not capture a DTMF digit. This provides another means to confuse certain types of DTMF detectors. Frequencies other than row and column frequencies can be generated as masking signals to confuse eavesdropping DTMF detectors.

Masking signals consisting of row and column or non-row and non-column frequencies can be continuous non-varying interference tones. However, sophisticated eavesdropping devices may be capable of identifying these masking signals and subtracting them out from the composite signal. Therefore, to keep the eavesdropping devices confused as to what the masking signal actually is, the masking signal may be varied over time in frequency, amplitude and/or phase. A random pattern is best for the receiving end to transmit. A random pattern is difficult for eavesdropping detectors to predict and therefore they are more likely to lose the information signal. For DTMF coding, masking signal generator 33 preferably varies the frequency between row and column frequencies, out-of-band frequencies and other in-band frequencies.

Another concept for masking signals in DTMF coding is to actually transmit valid DTMF frequency pairs. These valid DTMF pairs produce invalid DTMF signatures when mixed with the DTMF pairs of the sending device. Significantly, at quiet times (at the sending end) when there are no transmitted DTMF pairs, the valid DTMF masking signals cause the eavesdropping detectors to capture invalid information. By causing the eavesdropping detectors not only to fail to capture the valid information but also to capture invalid information, the security protection may be even more effective.

FSK (frequency shift keying) and PSK (phase shift keying) encoded information may utilize a different encoding method. In FSK encoding transmission, the masking signal is centered around the carrier frequencies. The masking signal may actually cancel out the information on the telephone line, yet be recreated at the receiving end in the hybrid/signal processing circuits (since the transmitted masking signal would be subtracted from a null signal, to produce the original information signal). In PSK encoding transmission, the masking signal may distort the phase changes of the information signal, thus producing invalid phase transitions for the eavesdropping detectors. The masking signal would also be centered around the carrier frequency to create distortion of the original information signal. In every case, generator 33 is adapted, as described, in accordance with the type of encoding used.

The concept of the masking signal varying with time in frequency and/or amplitude and/or phase is applicable to both FSK and PSK encoding transmissions. This technique keeps the eavesdropping detectors from determining what the masking signals are and then being able to subtract them out as well.

Voice represents another encoding method. With voice recognition devices, information is transmitted to machines to control operations through regular speech. The concept of transmitting a masking signal from the receiving end applies to this transmission as well. This process would be half-duplex as a masking signal would be transmitted during incoming human speech, yet would be disabled as speech is transmitted from the receiving end to a human at the sending end. Masking signals may be created to accomplish distortion of the incoming speech for two applications, one for eavesdropping voice recognition devices and the other for eavesdropping humans. Masking signals needed to confuse voice recognition devices would alter the frequency spectrum and/or pitch of the incoming composite voice signal. To confuse eavesdropping humans, masking signals would sweep the frequency range with high amplitudes to override in volume the incoming speech, or add and subtract to the incoming signal to cause drop-outs. The concept of masking signals varying with time in frequency and/or amplitude and/or phase is applicable to voice transmission as well.

Although the invention has been described with reference to particular embodiments, it is to be understood that these embodiments are merely illustrative of the application of the principals of the invention. For example, facsimile transmission utilizes voiceband signals and intelligent interception of facsimile transmissions may be prevented by transmitting a masking signal from the receiving end of the communications path. Thus it is to be understood that numerous modifications may be made in the illustrative embodiments of the invention and other arrangements may be devised without departing from the spirit and scope of the invention.

We claim:

1. In a communications system for interconnecting first and second sites over a two-direction line, wherein standard tone encoded information signals are transmitted over said line in at least one direction from said first site to said second site, apparatus for preventing intelligible interception of said information signals but allowing intelligible reception of said tone encoded information signals at said second site comprising:

means disposed solely at said second site for injecting a masking signal on said line; and means at said second site for extracting tone encoded information signals received on said line from said first site which are superimposed on said masking signal;

said apparatus having no part thereof at said first site.

2. The apparatus of claim 1 wherein said signal extracting means includes a three-port device; a first transmit-receive port of which is connected to said line, a second transmit port to which said masking signal injecting means is connected, and a third receive port at which extracted tone encoded information signals appear; said device exhibiting substantially higher attenuation between said second and third ports than between both said first and second ports, and said first and third ports.

3. The apparatus of claim 2 further including means for sensing the level of tone encoded signals at said receive port and for controlling the amplitude of the injected masking signal which appears on said line in accordance with the sensed level.

4. The apparatus of claim 2 wherein said tone encoded information signals are dual tone multi-frequency digits, each digit of which is represented by one of four row frequencies and one of four column frequencies, and said masking signal consists of at least two row frequencies or at least two column frequencies.

5. The apparatus of claim 4 wherein said signal injecting means continuously varies the at least two frequencies of said masking signal.

6. The apparatus of claim 4 wherein said signal injecting means continuously varies at least the amplitudes, frequencies or phases of the at least two frequencies of said masking signal.

7. The apparatus of claim 2 wherein said tone encoded information signals are encoded as frequency shift keyed data, and said masking signal is a tone which is continuously varied in amplitude or frequency over the transmission passband.

8. The apparatus of claim 2 wherein said tone encoded information signals are encoded as phase shift keyed data, and said masking signal is at least one tone used for said encoded signals whose phase is continuously varied.

9. The apparatus of claim 2 further including signal processing means for processing a signal appearing at said receive port in accordance with the injected masking signal in order to adjust the injected masking signal in the signals appearing at said receive port.

10. The apparatus of claim 9 wherein said tone encoded information signals are dual tone multi-frequency digits, each digit of which is represented by one of four row frequencies and one of four column frequencies, and said masking signal consists of at least two row frequencies or at least two column frequencies.

11. The apparatus of claim 10 wherein said

12. The apparatus of claim 10 wherein said signal injecting means continuously varies at least the amplitudes, frequencies or phases of the at least two frequencies of said masking signal.

13. The apparatus of claim 9 wherein said tone encoded information signals are encoded as frequency shift keyed data, and said masking signal is a tone which is continuously varied in amplitude or frequency over the transmission passband.

14. The apparatus of claim 9 wherein said tone encoded information signals are encoded as phase shift keyed data, and said encoded signals whose phase is continuously varied.

15. In a communications system for interconnecting first and second sites over a two-direction line, wherein standard information signals are transmitted over said line in at least one direction from said first site to said second site, apparatus for preventing intelligible interception of said information signals but allowing intelligible reception of said information signals at said second site comprising:

means disposed solely at said second site for injecting a masking signal on said line; and means at said second site for extracting information signals received on said line from said first site which are superimposed on said masking signal;

said apparatus having no part thereof at said first site.

16. The apparatus of claim 15 wherein said signal extracting means includes a three-port device; a first transmit-receive port of which is connected to said line, a second transmit port to which said masking signal injecting means is connected, and a third receive port at which extracted information signals appear; said device exhibiting substantially higher attenuation between said second and third ports than between both said first and second ports, and said first and third ports.

17. The apparatus of claim 16 further including means for sensing a characteristic of a signal at said receive port and for adjusting the injected masking signal which appears on said line in accordance with the sensed characteristic.

18. The apparatus of claim 17 wherein said signal injecting means continuously varies the characteristics of said masking signal.

19. The apparatus of claim 17 further including signal processing means for processing a signal appearing at said receive port in accordance with the injected masking signal in order to adjust the injected masking signal in the signals appearing at said receive port.

20. The apparatus of claim 15 wherein said signal injecting means continuously varies the characteristics of said masking signal.

21. The apparatus of claim 15 further including signal processing means for processing received signals in accordance with the injected masking signal in order to adjust the injected masking signal in the receive signals.

22. In a communications system for interconnecting first and second sites over a two-direction line, wherein standard tone encoded information signals are transmitted over said line in at least one direction from said first site to said second site, a method for preventing intelligible interception of said information signals but allowing intelligible reception of said tone encoded information signals at said second site, said method comprising the steps of:

injecting a masking signal on said line at said second site by using apparatus located solely at said second site; and extracting at said second site tone encoded information signals received on said line from said first site which are superimposed on said masking signal.

23. The method of claim 22 further including the steps of sensing the level of tone encoded signals at said second site and controlling the amplitude of the injected masking signal which appears on said line in accordance with the sensed level.

24. The method of claim 23 wherein said tone encoded information signals are dual tone multi-frequency digits, each digit of which is represented by one of four row frequencies and one of four column frequencies, and said injecting step includes injecting a masking signal which consists of at least two row frequencies or at least two column frequencies.

25. The method of claim 24 wherein said injecting step includes continuously varying the at least two frequencies of said masking signal.

26. The method of claim 24 wherein said injecting step includes continuously varying at least the amplitudes, frequencies or phases of the at least two frequencies of said masking signal.

27. The method of claim 23 wherein said tone encoded information signals are encoded as frequency shift keyed data, and said injecting step includes injecting a tone which is continuously varied in amplitude or frequency over the transmission passband.

28. The method of claim 23 wherein said tone encoded information signals are encoded as phase shift keyed data, and said injecting step includes injecting at least one tone used for said encoded signals whose phase is continuously varied.

29. The method of claim 23 further including the step of processing a signal received at said second site in accordance with the injected masking signal in order to adjust the injected masking signal in the received signals.

30. The method of claim 29 wherein said tone encoded information signals are dual tone multi-frequency digits, each digit of which is represented by one of four row frequencies and one of four column frequencies, and said injecting step includes injecting a masking signal which consists of at least two row frequencies or at least two column frequencies.

31. The method of claim 30 wherein said injecting step includes continuously varying the at least two frequencies of said masking signal.

32. The method of claim 30 wherein said injecting step includes continuously varying at least the amplitudes, frequencies or phases of the at least two frequencies of said masking signal.

33. The method of claim 29 wherein said tone encoded information signals are encoded as frequency shift keyed data, and said injecting step includes injecting a tone which is continuously varied in amplitude or frequency over the transmission passband.

34. The method of claim 29 wherein said tone encoded information signals are encoded as phase shift keyed data, and said injecting step includes injecting at least one tone used for said encoded signals whose phase is continuously varied.

35. The method of claim 22 further including the step of processing a signal received at said second site in accordance with the injected masking signal in order to adjust the injected masking signal in the received signals.

36. The method of claim 35 wherein said injecting step includes continuously varying at least two frequencies of said masking signal.

37. The method of claim 35 wherein said injecting step includes continuously varying at least the amplitudes, frequencies or phases of at least two frequencies of said masking signal.

38. The method of claim 35 wherein said tone encoded information signals are encoded as frequency shift keyed data, and said injecting step includes injecting a tone which is continuously varied in amplitude or frequency over the transmission passband.

39. The method of claim 35 wherein said tone encoded information signals are encoded as phase shift keyed data, and said injecting step includes injecting at least one tone used for said encoded signals whose phase is continuously varied.

40. The method of claim 22 wherein said tone encoded information signals are dual tone multi-frequency digits, each digit of which is represented by one of four row frequencies and one of four column frequencies, and said injecting step includes injecting a masking signal which consists of at least two row frequencies or at least two column frequencies.

41. The method of claim 40 wherein said injecting step includes continuously varying the at least two frequencies of said masking signal.

42. The method of claim 40 wherein said injecting step includes continuously varying at least the amplitudes, frequencies or phases of the at least two frequencies of said masking signal.

43. The method of claim 22 wherein said tone encoded information signals are encoded as frequency shift keyed data, and said injecting step includes injecting a tone which is continuously varied in amplitude or frequency over the transmission passband.

44. The method of claim 22 wherein said tone encoded information signals are encoded as phase shift keyed data, and said injecting step includes injecting at least one tone used for said encoded signals whose phase is continuously varied.

45. In a communications system interconnecting first and second sites over a two-direction line, wherein information signals are transmitted over said line in at least one direction from said first site to said second site, a method for preventing intelligible interception of said information signals but allowing intelligible reception of said information signals at said second site, said method comprising the steps of:

injecting a masking signal on said line at said second site by using apparatus located solely at said second site; and extracting at said second site information signals received on said line from said first site which are superimposed on said masking signal.

46. The method cf claim 45 further including the steps of sensing a characteristic of a signal received at said second site and adjusting the injected masking signal which appears on said line in accordance with the sensed characteristic.

47. The method of claim 46 wherein said information signals are encoded as frequency shift keyed data, and said injecting step includes injecting a tone which is continuously varied in amplitude or frequency over the transmission passband.

48. The method of claim 46 wherein said information signals are encoded as phase shift keyed data, and said injecting step includes injecting at least one tone used for said encoded signals whose phase is continuously varied.

49. The method of claim 46 further including the step of processing received signals at said second site in accordance with the injected masking signal in order to adjust the injected masking signal in the received signals.

50. The method of claim 45 wherein said information signals are encoded as frequency shift keyed data, and said injecting step includes injecting a tone which is continuously varied in amplitude or frequency over the transmission passband.

51. The method of claim 45 wherein said information signals are encoded as phase shift keyed data, and said injecting step includes injecting at least one tone used for said encoded signals whose phase is continuously varied.

52. The method of claim 45 further including the step of processing received signals at said second site in accordance with the injected masking signal in order to adjust the injected masking signal in the received signals.

53. In a communications system wherein information signals are generated at an unsecured sending device in standardized intelligible form, and transmitted to a receiving device through a communication link, apparatus for securing information signals transmitted to said receiving device irrespective of said sending device, said apparatus comprising:

means, disposed in association with said receiving device with no part thereof at said sending device, for, independently of any signal from said sending device other than said information signal, injecting a masking signal onto said link, superimposing said masking signal on said information signals to generate composite communicated signals, rendering interceptions of said communicated signals unintelligible; and means, disposed in association with said receiving device with no part thereof at said sending device, for extracting said information signals from said composite communicated signals.

54. The apparatus of claim 53, wherein said information signals are dual tone multi-frequency encoded signals, whereby each digit represented in said information signals is represented by one of a first set of discrete frequencies and one of a second set of discrete frequencies, and said masking signal comprises at least one discrete frequency chosen from one of said sets of discrete frequencies.

55. The apparatus of claim 54, wherein said communication system comprises a telephone system.

56. The apparatus of claim 55, wherein said sending device comprises a standard telephone instrument.

57. The apparatus of claim 54, wherein said masking signals consists of at least two frequencies chosen from one of said sets of discrete frequencies.

58. The apparatus of claim 54, further including means for continuously varying said discrete frequency chosen from one of said sets of frequencies.

59. The apparatus of claim 54, further including means for continuously varying at least the amplitude, frequency or phase of said at least one discrete frequency of said masking signal.

60. The apparatus of claim 53, wherein said communication system comprises a telephone system.

61. The apparatus of claim 60, wherein said sending device comprises a standard telephone instrument.

62. The apparatus of claim 53, wherein said information signals comprise frequency shift keyed data having a predetermined passband associated therewith, and said masking signal is a tone which is continuously varied in amplitude or frequency over the transmission passband.

63. The apparatus of claim 53, wherein said information signals comprise phase shift keyed data, and said masking signal is at least one tone used for said encoded signals whose phase is continuously varied.

64. In an open communications system wherein information signals are generated at any of a multiplicity of unsecured sending devices in a standardized intelligible form, and transmitted to a designated receiving device through a communication link, a receiving device including information signal securing means for securing information signals transmitted to said receiving device irrespective of the originating sending device from which said information signals are transmitted;

said information signal securing means comprising:

means for, independently of any signal from said originating sending device other than said information signals, injecting a masking signal onto said link, superimposing said masking signal on said information signals to generate composite communicated signals rendering interceptions of said communicated signals unintelligible; and means for extracting said information signals from said superimposed masking signal.

65. The apparatus of claim 64, wherein said communication system comprises a telephone system.

66. The apparatus of claim 65, wherein said sending device comprises a standard telephone instrument.

67. The apparatus of claim 64, wherein said information signals are dual tone multi-frequency encoded signals, whereby each digit represented in said information signals is represented by one of a first set of discrete frequencies and one of a second set of discrete frequencies, and said masking signal comprises at least one discrete frequency chosen from one of said sets of discrete frequencies.

68. The apparatus of claim 67, wherein said masking signal comprises at least two frequencies chosen form one of said sets of discrete frequencies.

69. The apparatus of claim 67, further including means for continuously varying said discrete frequency chosen from one of said sets of frequencies.

70. The apparatus of claim 64, wherein said information signals comprise frequency shift keyed data having a predetermined passband associated therewith, and said masking signal is a tone which is continuously varied in amplitude or frequency over the transmission passband.

71. The apparatus of claim 64, wherein said information signals comprise phase shift keyed data, and said masking signal is at least one tone used for said encoded signals whose phase is continuously varied.

72. In a communication system wherein information signals are generated at an unsecured sending device in standardized intelligible form, and transmitted to a receiving device through a communication link, a method for securing information signals transmitted to said receiving device irrespective of said sending device, said method comprising the steps of:

at said receiving device, independently of said sending device and any signal from said sending device other than said information signals, injecting a masking signal onto said link, superimposing said masking signal on said information signals to generate composite communicated signals, rendering interceptions of said communicated signals unintelligible; and at said receiving device, independently of said sending device and any signal from said sending device other than said information signals, extracting said information signal from said composite communicated signal.

73. The method of claim 72, wherein said information signals are dual tone multi-frequency encoded signals, whereby each digit represented in said information signals is represented by one of a first set of discrete frequencies and one of a second set of discrete frequencies, and said injecting a masking signal step comprises injecting at least one discrete frequency chosen from one of said sets of discrete frequencies.

74. The method of claim 73, wherein said injecting a masking signal step comprises injecting at least two frequencies chosen from one of said sets of discrete frequencies.

75. The method of claim 73, further including the step of continuously varying said discrete frequency chosen from one of said sets of frequencies.

76. The method of claim 72, wherein said information signals comprise frequency shift keyed data having a predetermined passband associated therewith, and said injecting a masking signal step comprises injecting a tone which is continuously varied in amplitude or frequency over the transmission passband.

77. The method of claim 72, wherein said information signals comprise phase shift keyed data, and said injecting a masking signal step comprises injecting at least one tone used for said encoded signals whose phase is continuously varied.

78. In a communications system wherein information signals are generated at a sending device in intelligible form and transmitted to a receiving device over a two-direction line, said receiving device comprising:

signal injecting means for injecting a masking signal, superimposed on said information signals to generate a composite signal on said line to render interceptions of said communicated signals unintelligible;

signal extracting means for extracting said information signals from said composite signal;

said signal extracting means including a three-port device, a first transmit-receive port of which is connected to said line, a second transmit port to which said masking signal injecting means is connected, and a third receive port at which said extracted information signals appear; said device exhibiting substantially higher attenuation between said second and third ports than between both said first and second ports, and said first and third ports; and means for sensing a characteristic of a signal at said receive port and for adjusting the injected masking signal which appears on said line in accordance with the sensed characteristic.

79. The apparatus of claim 78 wherein said signal injecting means continuously varies the characteristics of said masking signal.

80. The apparatus of claim 78 further including signal processing means for processing a signal appearing at said receive port in accordance with the injected masking signal in order to adjust the injected masking signal in order to adjust the injected masking signal in the signals appearing at said receive port.

81. The apparatus of claim 78 further including signal processing means for processing a signal appearing at said receive port in accordance with the injected masking signal in order to adjust the injected masking signal in the received signals.

82. In a communications system wherein information signals are generated at a sending device in intelligible form and transmitted to a receiving device over a two-direction line, said receiving device comprising:

signal injecting means for injecting a masking signal, superimposed on said information signals to generate a composite signal on said line to render interceptions of said communicated signals unintelligible;

signal extracting means for extracting said information signals from said composite signal;

said signal extracting means including a three-port device, a first transmit-receive port of which is connected to said line, a second transmit port to which said masking signal injecting means is connected, and a third receive port at which said extracted information signals appear; said device exhibiting substantially higher attenuation between said second and third ports than between both said first and second ports, and said first and third ports; and means for sensing a characteristic of a signal at said receive port and for adjusting the injected masking signal which appears on said line in accordance with the sensed characteristic;

wherein said signal injecting means continuously varies the characteristics of said masking signal.

83. A method for transmitting frequency shift keyed information signals generated by a sending device and transmitted to a receiving device over a communication link, said method comprising the steps of:

injecting a masking signal onto said link, superimposing said masking signal on said information signals to generate composite communicated signal rendering interceptions of said communicated signals unintelligible, said masking signal comprising a tone which is continuously varied in amplitude or frequency over the transmission passband; and extracting said information signal from said superimposed masking signal.

84. The method of claim 83 wherein said injecting step is effected at said receiving device.

* * * * *